US007201609B2

(12) United States Patent
Ishikawa

(10) Patent No.: US 7,201,609 B2
(45) Date of Patent: Apr. 10, 2007

(54) CONNECTOR WITH A SEALING BOOT HAVING INNER AND OUTER SEALING LIPS

(75) Inventor: Yoshiyuki Ishikawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/348,147

(22) Filed: Feb. 6, 2006

(65) Prior Publication Data

US 2006/0178049 A1 Aug. 10, 2006

(30) Foreign Application Priority Data

Feb. 9, 2005 (JP) ..... 2005-033268

(51) Int. Cl.
*H01R 13/40* (2006.01)

(52) U.S. Cl. ..... 439/587; 439/157; 439/372

(58) Field of Classification Search ..... 439/587, 439/372, 157, 589, 271
See application file for complete search history.

(56) References Cited

U.S. PATENT DOCUMENTS 5,203,723 A * 4/1993 Ritter ..... 439/589
5,616,049 A * 4/1997 Schwager et al. ..... 439/455
6,183,275 B1 * 2/2001 Okura et al. ..... 439/157
6,375,500 B1 * 4/2002 Murakami et al. ..... 439/587
6,638,108 B2 * 10/2003 Tachi ..... 439/595
6,685,496 B2 2/2004 Ookura ..... 439/372

* cited by examiner

*Primary Examiner*—Hae Moon Hyeon
(74) *Attorney, Agent, or Firm*—Gerald E. Hespos; Anthony J. Casella

(57) ABSTRACT

A connector (10) has a housing (11) with an outer peripheral surface (11S). A rubber boot (15) has a tubular sealing portion (21) with an inner peripheral surface that mounts over and seals to the outer peripheral surface (11S) of the housing (11). Thus, a compressive elasticity amount of the sealing portion (21) is not affected by a posture of the first connector (10) when the first connector (10) is fit in a second connector (40). Therefore, the sealing performance of the sealing portion (21) does not deteriorate in dependence on the posture of the first connector (10) when the first connector (10) is fit in the second connector (40).

7 Claims, 9 Drawing Sheets

CONNECTOR WITH A SEALING BOOT HAVING INNER AND OUTER SEALING LIPS

BACKGROUND OF THE INVENTION

1. Field of the Invention

The invention relates to a connector with a waterproof function.

2. Description of the Related Art

U.S. Pat. No. 6,685,496 discloses a connector with a waterproof function. More particularly, the known connector with a waterproof function has a housing and terminal fittings are accommodated in the housing. Electric wires are fixed to the respective terminal fittings and extend from a rear end of the housing. The connector further includes a tubular rubber boot that is mounted on the housing. The rubber boot covers both an outer peripheral surface of the housing and the rear end of the housing, and the electric wires penetrate through the rubber boot. A cover is mounted on the housing and covers the rubber boot.

A ring-shaped seal is formed along the edge of an opening of the rubber boot. The seal has a first sealing surface that contacts an end surface of the opening of the cover and a second sealing surface that contacts a front surface of a mating connector. The seal is compressed elastically between the cover and the mating connector in a fit-in direction in which the connector is fit in the mating connector. As a result, the two sealing surfaces closely contact the cover and the mating connector elastically to prevent water from penetrating into the housing beyond the rear surface thereof from the gap between the rubber boot and the housing.

The seal of the above-described connector is compressed elastically in the fit-in direction between the cover and the mating connector to display a sealing function. However, it is difficult to fit the connectors together with the respective front surfaces confronting each other at a high accuracy in view of dimensional and mounting tolerances. Thus, there is a fear that both connectors will fit together in an inclined posture. In this case, the compressive elasticity of the seal becomes peripherally nonuniform and there is a fear that the seal will have a low degree of sealing performance.

The invention has been completed in view of the above-described situation. Therefore it is an object of the invention to provide a connector that prevents water from penetrating beyond a rear surface of a housing from a gap between a rubber boot and the housing.

SUMMARY OF THE INVENTION

The invention relates to a connector with a housing made of synthetic resin and terminal fittings accommodated in the housing. Electric wires are fixed respectively to the terminal fittings and extend outside from a rear surface of the housing. A tubular rubber boot is mounted on the housing to cover an outer peripheral surface and a rear surface of the housing. Thus, the electric wires penetrate through the rubber boot. The connector is fit in a mating connector so that a front surface of the housing confronts a front surface of a housing of the mating connector. A seal is formed on the rubber boot and elastically contacts the peripheral surface of the housing. The seal seals the gap between the inner peripheral surface of the rubber boot and the peripheral surface of the housing so that water cannot penetrate through the gap into the rear surface of the housing. Additionally, the compressive elasticity of the seal is not affected by the posture of the connector when the connector is fit in the mating connector. Therefore, the performance of the seal does not deteriorate in dependence on the posture of the connector when the connector is fit in the mating connector.

A cover preferably is mounted on the housing and covers the rubber boot so that the seal is sandwiched between the cover and the housing over an entire periphery of the seal. Additionally, the cover preferably is more rigid than the rubber boot. Therefore the compressive elasticity amount of the seal for the periphery of the first housing is uniform over the entire periphery of the seal. Thus, the seal displays a high degree of sealing performance.

A main lip preferably is formed on an inner peripheral surface of the seal and elastically contacts the peripheral surface of the housing. An auxiliary lip preferably is formed on a peripheral surface of the seal at a position corresponding to the main lip and elastically contacts an inner peripheral surface of the cover. Accordingly, the elastic contact of the auxiliary lip with the cover generates an elastic restoring force that is applied as an elastic contact pressure of the main lip for the first housing. Thus, the sealing performance of the seal is improved.

The housing and the cover preferably are approximately quadrangular and positioning projections preferably project from peripheral surfaces of at least two of the four sides of the housing. The positioning projections penetrate through the rubber boot and fit in positioning holes of the cover. Thus, the cover is mounted at a predetermined position on the housing, and there are no fluctuations of the dimension of the gap between the peripheral surface of the housing and the inner peripheral surface of the cover. Accordingly, the compressive elasticity of the seal will not fluctuate and the seal displays a high sealing performance.

DETAILED DESCRIPTION OF THE PREFERRED EMBODIMENTS

Figure 1:
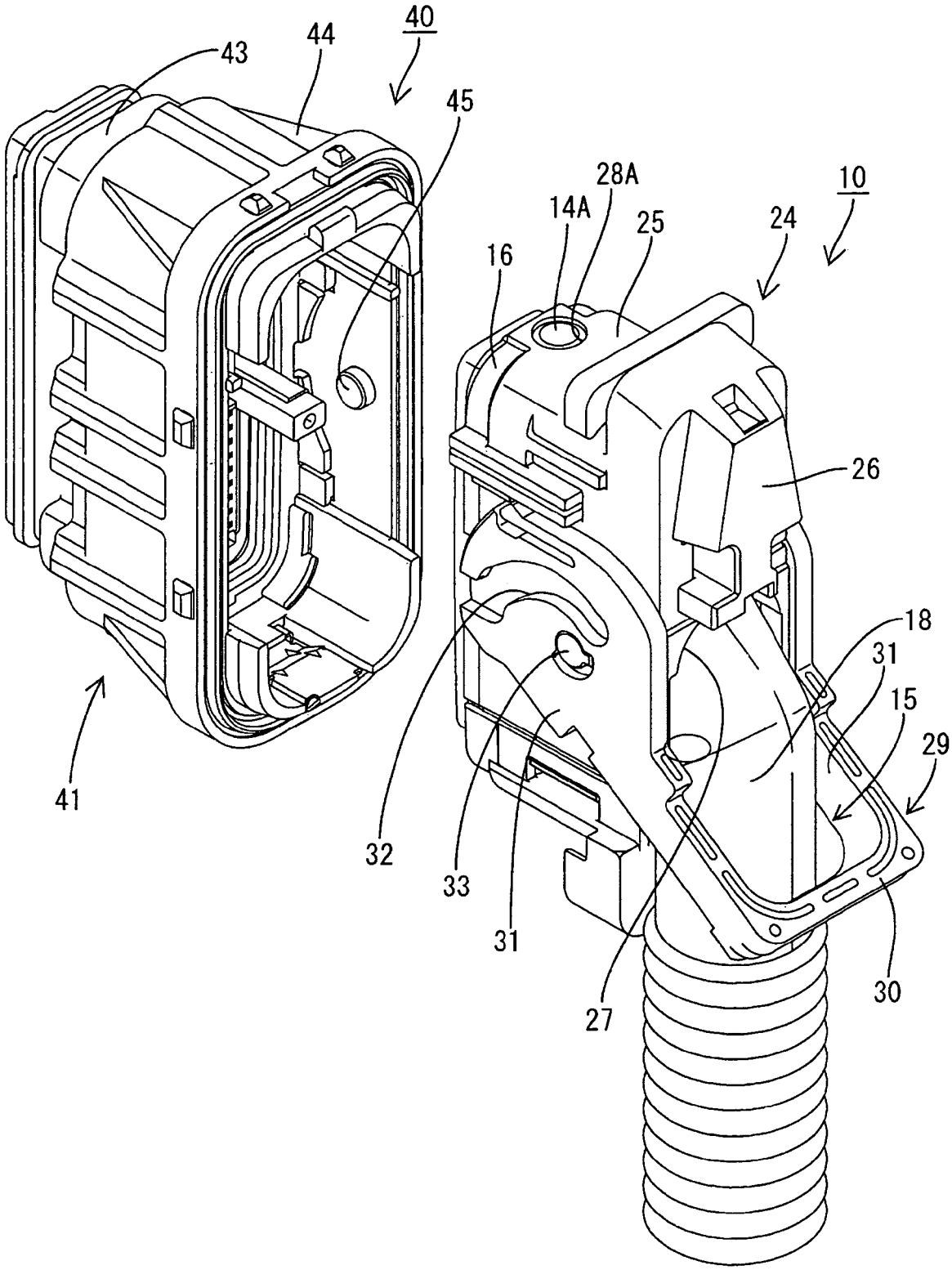
FIG. 1 is perspective view showing a state in which first and second connectors of a first embodiment are separated from each other.
Figure 2:
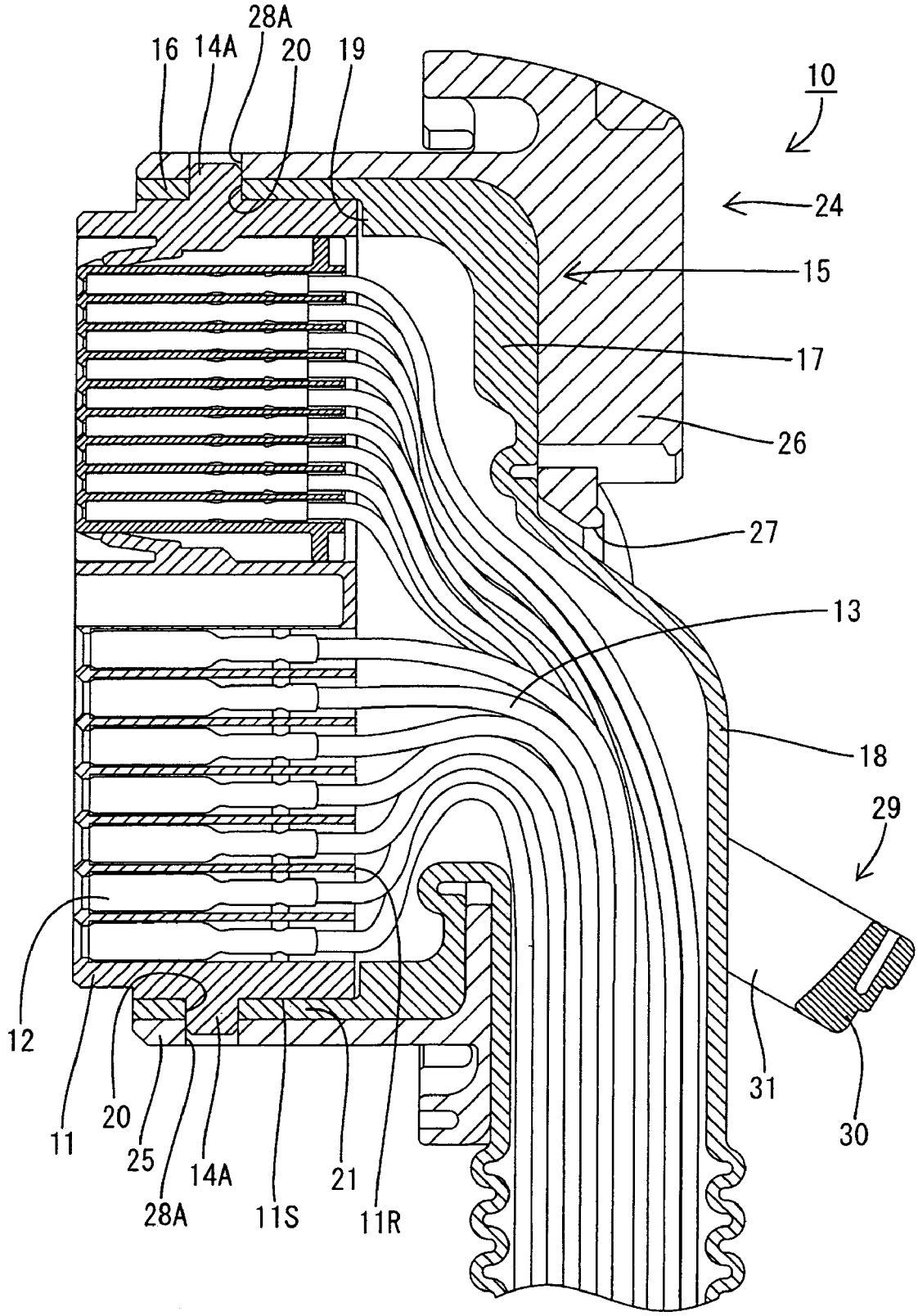
FIG. 2 is a vertical sectional view showing the first connector.
Figure 3:
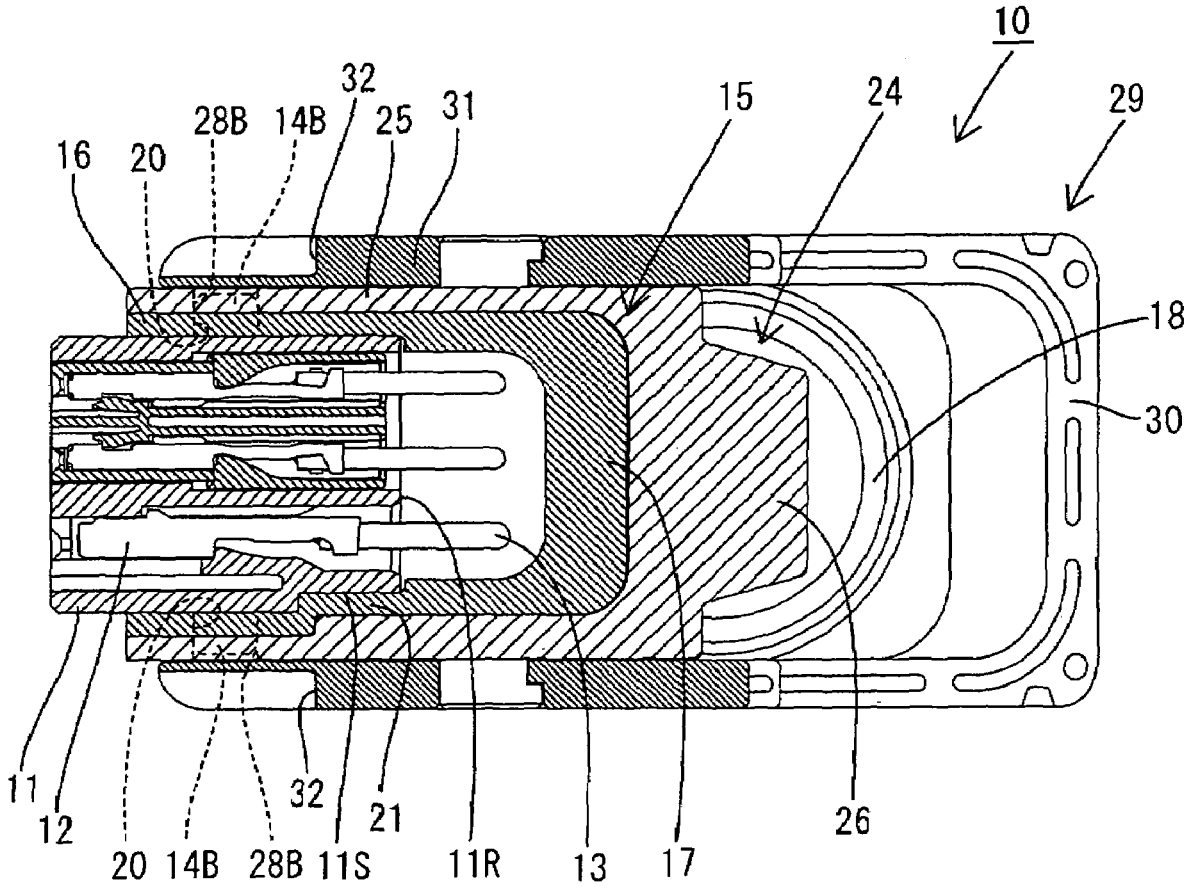
FIG. 3 is a horizontal sectional view showing the first connector.
Figure 4:
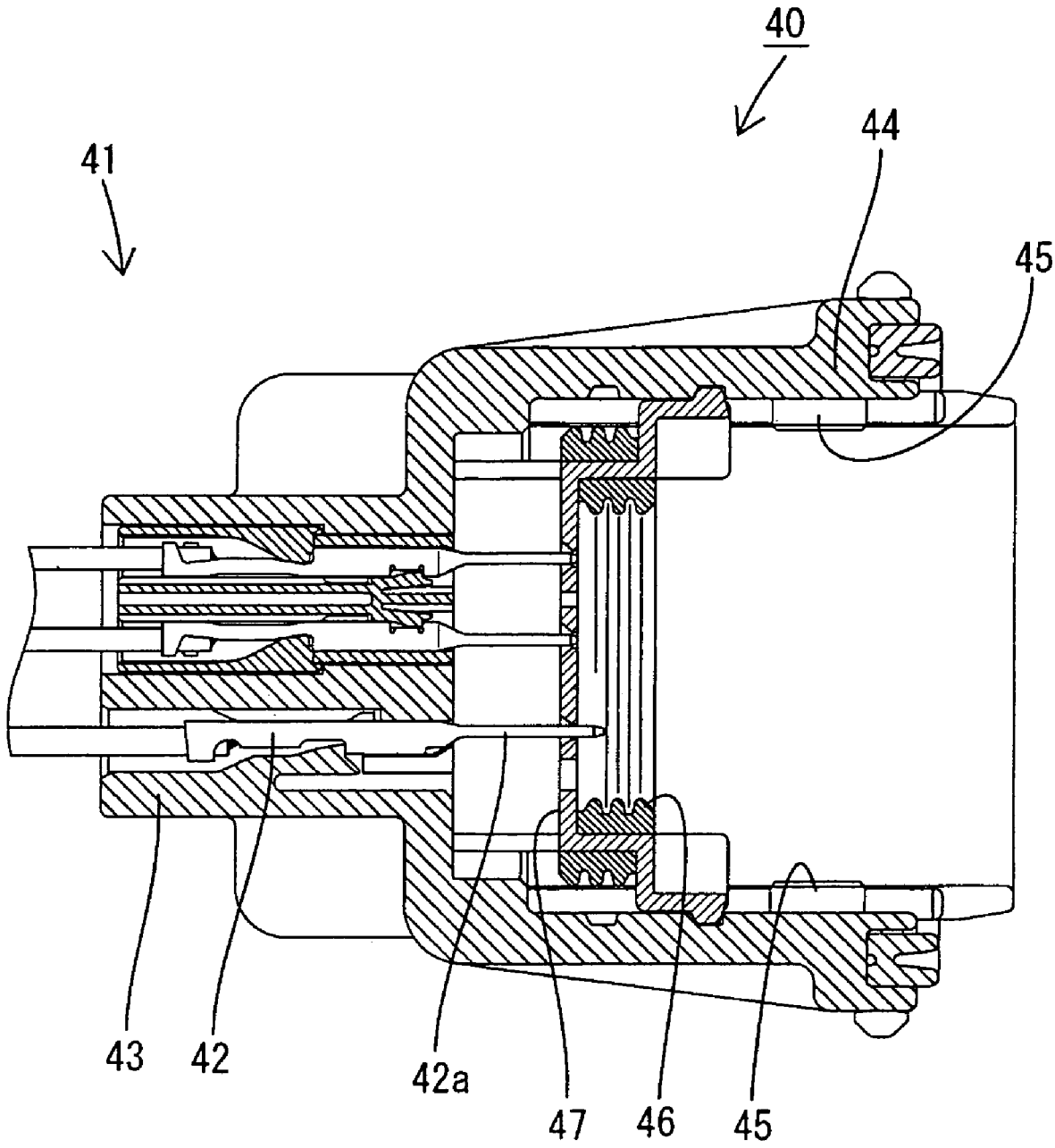
FIG. 4 is a horizontal sectional view showing a second connector.
Figure 5:
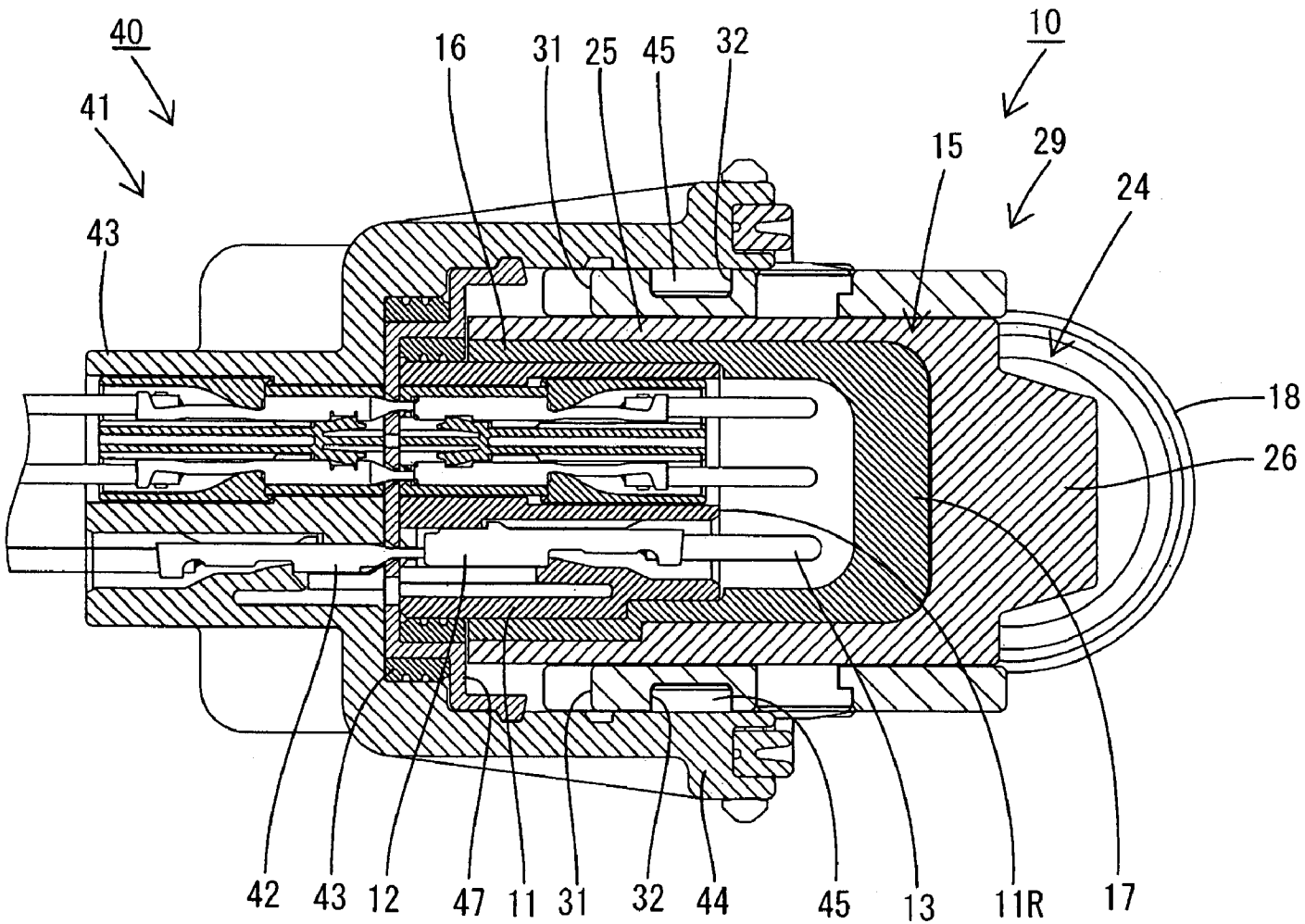
FIG. 5 is a horizontal sectional view showing a state in which the first and second connectors are fitted in each other.
Figure 6:
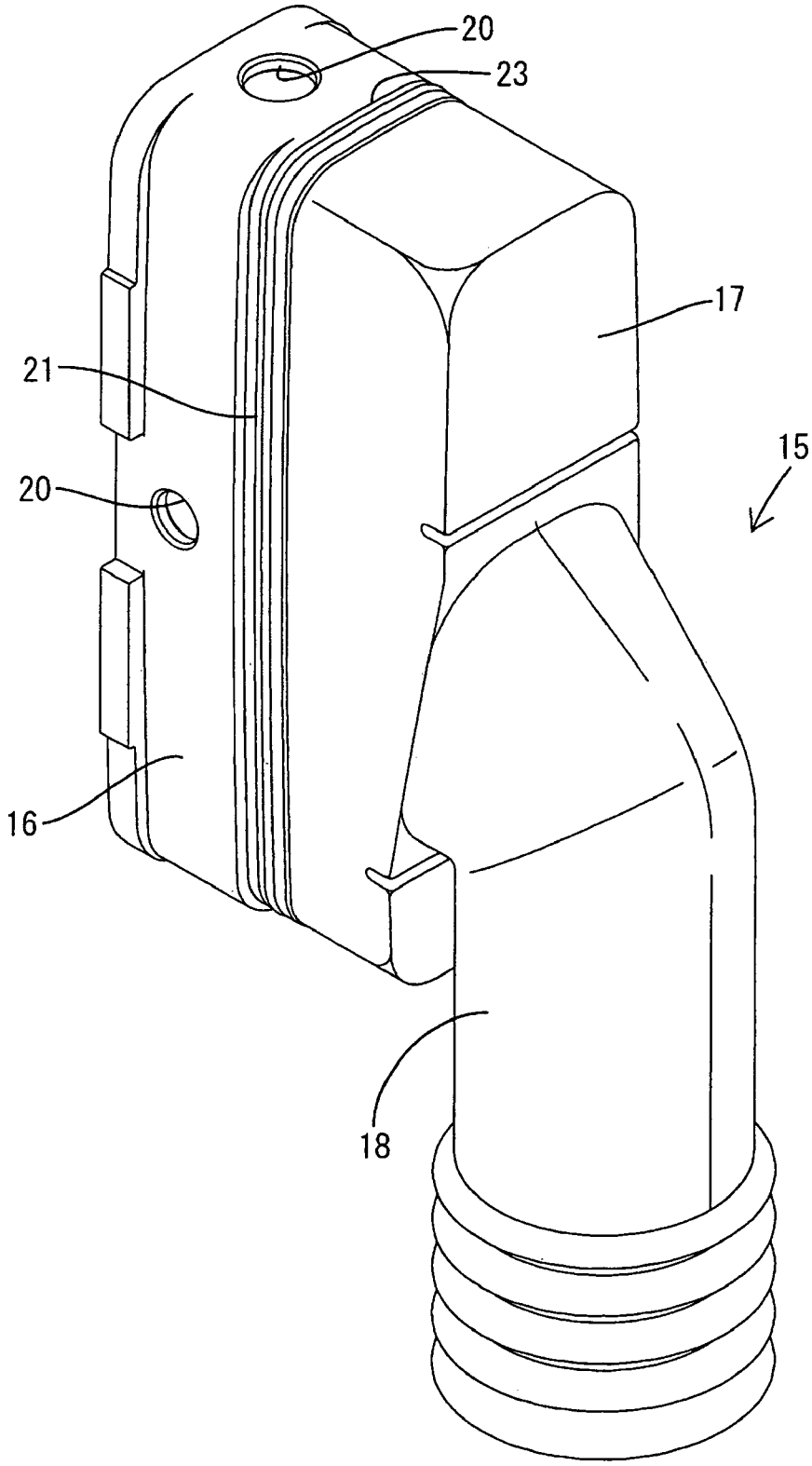
FIG. 6 is perspective view showing a rubber boot.
Figure 7:
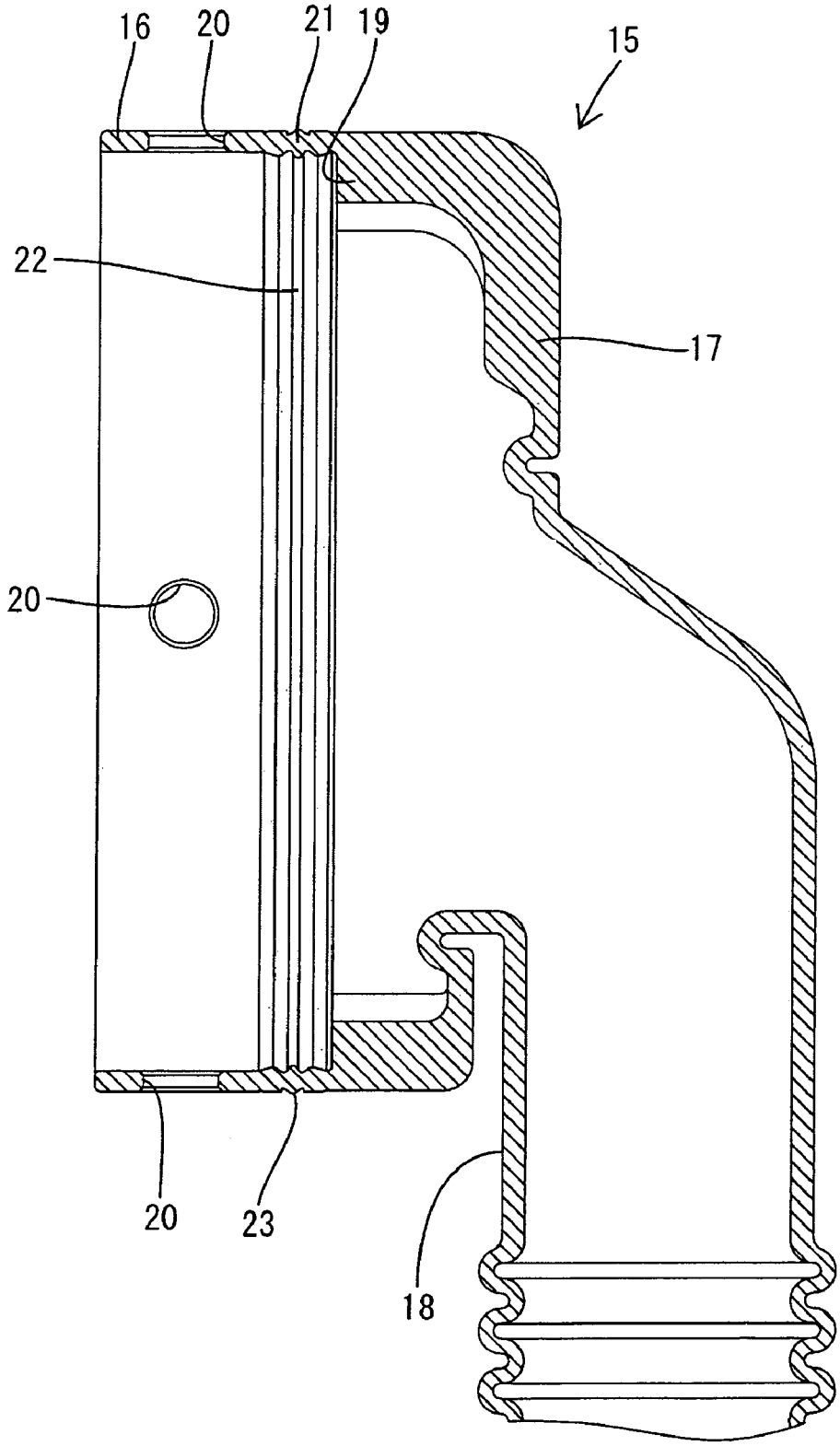
FIG. 7 is a vertical sectional view showing the rubber boot.
Figure 8:
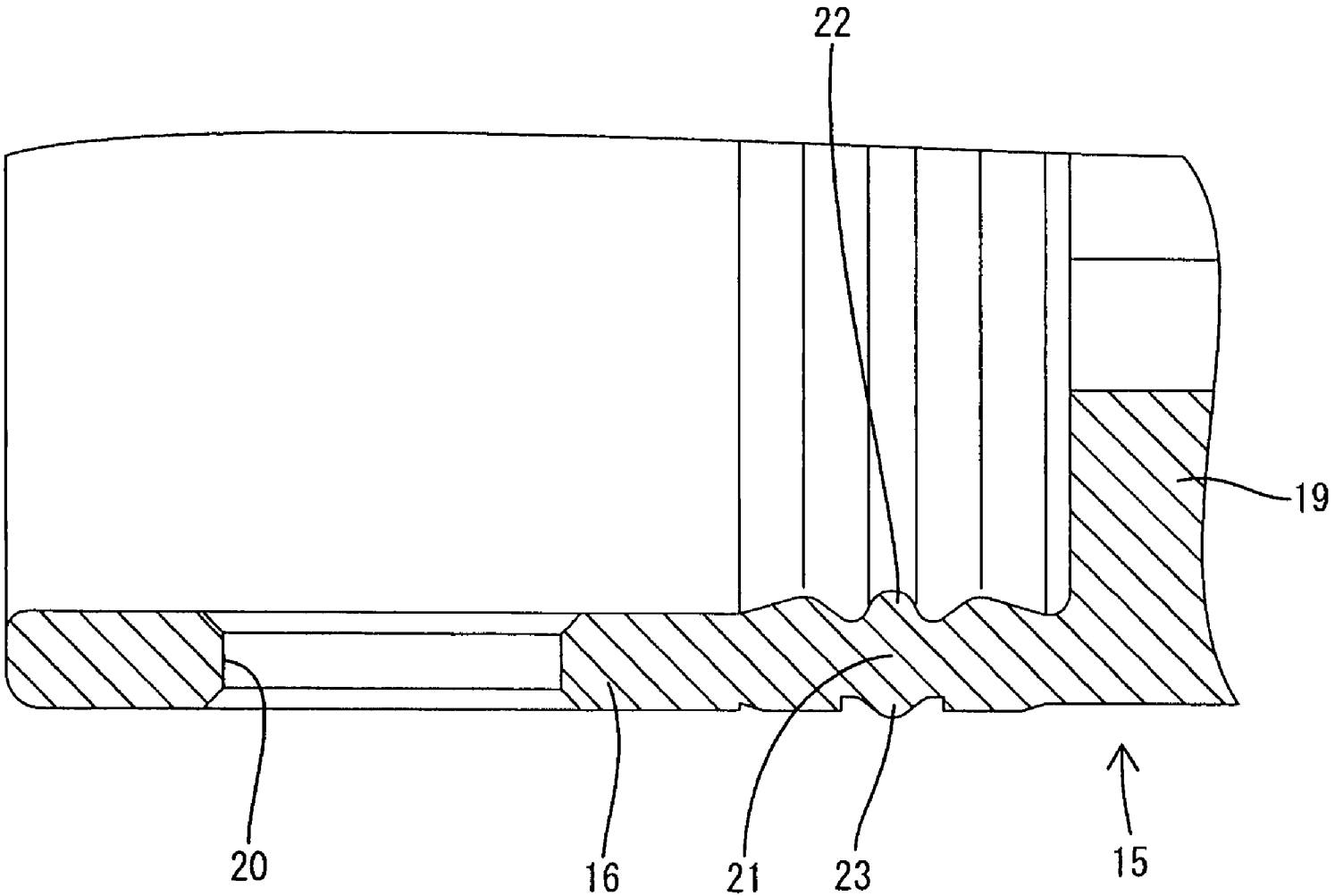
FIG. 8 is a partly enlarged vertical sectional view showing a sealing portion of the rubber boot.
Figure 9:
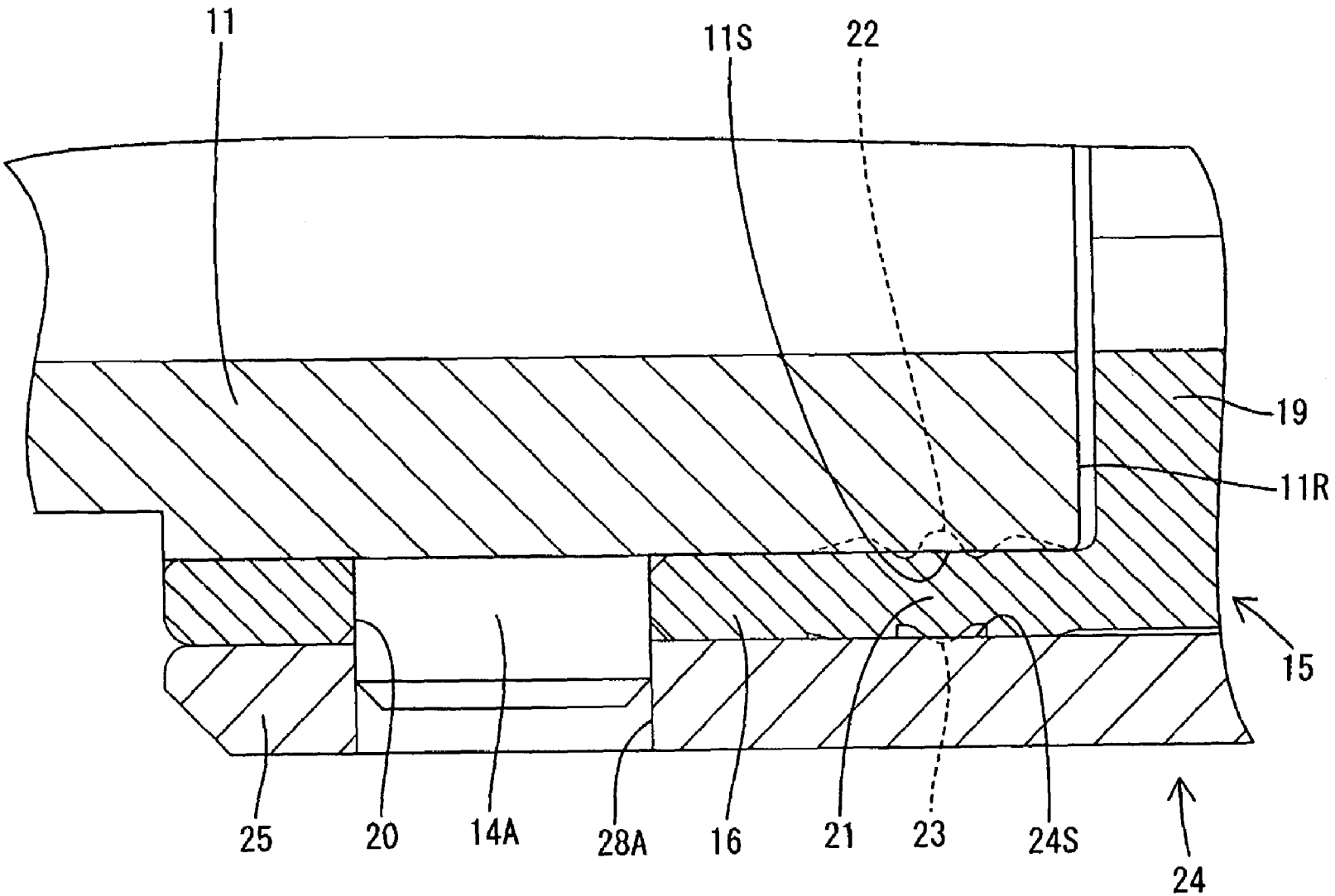
FIG. 9 is a partly enlarged vertical sectional view showing a first housing and a sealing portion of the rubber boot.

A connector assembly according to the invention includes first and second connectors identified generally by the numerals 10 and 40 in FIGS. 1 to 9. The first connector 10 has a first housing 11. The first housing 11 is made of synthetic resin and has the shape of a long quadrangular block. First terminal fittings 12 are inserted into the first housing 11 from a rear side thereof. An electric wire 13 is fixed to a rear end of each of the first terminal fittings 12. The electric wire 13 extends to the outside from a rear surface 11R of the first housing 11. Upper and lower positioning projections 14A are formed on upper and lower surfaces of the periphery of the first housing 11 and have column-shaped axes that project vertically in a direction normal to a direction in which the first connector 10 is fit in the second connector 40. Upper and lower positioning projections 14B are formed on left and right surfaces of the periphery of the first housing 11 and have column-shaped axes that project in a width direction normal to the direction in which the first connector 10 is fit in the second connector 40. A sealing surface 11S is formed on the outer peripheral surface of the first housing 11 in a region rearward from the positioning projections 14A, 14B. The sealing surface 11S is continuous around the outer periphery of the first housing 11.

The first connector 10 further includes a rubber boot 15. The rubber boot 15 has a quadrangular tubular part 16 fit on the periphery of the first housing 11. The quadrangular pillar-shaped part 16 has upper and lower plates and left and right plates that extend between the upper and lower plates. Additionally, the quadrangular tubular part 16 has a rear wall 17 and a cylindrical part 18 extends integrally from the rear wall 17 of the quadrangular pillar-shaped part 16. The cylindrical part 18 is curved down from the rear wall 17.

A step 19 is formed continuously around an inner peripheral surface of the quadrangular tubular part 16. A circular through-hole 20 is formed on each of upper and lower plates of the quadrangular tubular part 16 and left and right plates thereof in a region forward from the step 19. The rubber boot 15 is mounted on the first housing 11, with a region of the rubber boot 15 forward from the step 19 of the quadrangular tubular part 16 placed on the outer peripheral surface of the first housing 11 and with the positioning projections 14A, 14B fit through the through-holes 20. Thus, the rubber boot 15 is held undisplaceably by the first housing 11 in vertical, widthwise, and longitudinal directions relative to the first housing 11 by the above-described fitting of the quadrangular tubular part 16 on the first housing 11 and the fit-in of the positioning projections 14A, 14B through the through-holes 20. The step 19 contacts a peripheral edge of the rear surface 11R of the first housing 11 from the rear side of the first connector 10 to prevent the rubber boot 15 from being displaced forward relative to the first housing 11. The electric wires 13 taken out rearward from the rear surface 11R of the first housing 11 pass through the region of the quadrangular tubular part 16 rearward from the step 19 and continue through the cylindrical part 18. Thus, the electric wires 13 extend down and to the outside of the rubber boot 15.

A sealing portion 21 is formed peripherally continuously with the quadrangular tubular part 16 in the region forward of the step 19 and rearward of the through-hole 20. A main lip 22 (see FIG. 8) is formed continuously around the entire inner peripheral surface of the sealing portion 21 and projects inward from the inner peripheral surface of the sealing portion 21. An auxiliary lip 23 (see FIG. 8) is formed continuously around the entire outer periphery of the sealing portion 21 and projects out from the outer peripheral surface of the sealing portion 21. The auxiliary lip 23 is substantially opposite the main lip 22 and hence the main lip 22 and the auxiliary lip 23 are at substantially equal distances from the front end of the quadrangular tubular part 16. The main lip 22 is formed continuously with the entire inner peripheral surface of the sealing portion 21 and is compressed elastically against the sealing surface 11S of the first housing 11.

The first connector 10 also has a cover 24 made of a material, such as synthetic resin, having a higher rigidity than the material from which the rubber boot 15 is formed. The cover 24 is formed unitarily to define a forwardly open quadrangular tubular part 25 and a rear wall 26 that closes a rear surface of the quadrangular tubular part 25. The quadrangular part 25 has opposed upper and lower walls and left and right walls that extend between the upper and lower walls. An escape hole 27 penetrates through the rear wall 26. Circular positioning holes 28A, 28B penetrate through each of the upper and lower walls of the quadrangular part 25 and the left and right walls thereof. A sealing surface 24S (see FIG. 9) is formed peripherally continuously around the inner peripheral surface of the quadrangular tubular part 25.

The cover 24 is mounted on the first housing 11 by placing the quadrangular part 25 of the cover 24 on the quadrangular tubular part 16, without forming a gap therebetween and by fitting leading ends of the positioning projections 14A, 14B that project out from the rubber boot 15 in the positioning holes 28A, 28B respectively. The engagement of the positioning projections 14A, 14B in the positioning holes 28A, 28B holds the cover 24 undisplaceably in the vertical, widthwise, and longitudinal directions on the first housing 11. The cylindrical part 18 of the rubber boot 15 passes through the escape hole 27 of the cover 24 and to the outside of the cover 24. Further with reference to FIG. 9, the auxiliary lip 23 of the rubber boot 15 is formed continuously with the entire sealing surface 24S of the cover 24 so that the auxiliary lip 23 is compressed elastically against the sealing surface 24S.

A lever 29 is mounted rotatably on a supporting shaft 33 projected from an outer surface of each of left and right walls of the cover 24. The lever 29 has an operating portion and left and right plate-shaped arms 31 extend from left and right ends of the operation portion 30. A cam groove 32 is formed on an outer surface of each of the arms 31.

The second connector 40 has a second housing 41 and a plurality of second terminal fittings 42. The second housing 41 has a terminal accommodation part 43 with the shape of a long quadrangular block. A hood 44 is formed unitarily with the terminal accommodation part 43 and extends forward from the terminal accommodation part 43. The hood 44 has the shape of a long quadrangular pillar. The second terminal fittings 42 are accommodated inside the terminal accommodation part 43. A tab 42*a* is disposed at the front end of each of the second terminal fittings 42. The tabs 42*a* project from the terminal accommodation part 43 and are disposed inside the hood 44. Two cam followers 45 project in from left and right inner surfaces of the hood 44. The hood 44 accommodates a moving plate 47 (see FIG. 4) having a sealing ring 46. The moving plate 47 is movable in the longitudinal direction, and hence parallel with the direction in which the first connector 10 fits in the second connector 40.

The first connector 10 can be fit in the second connector 40 so that the first housing 11, the quadrangular tubular part 16 of the rubber boot 15, and the quadrangular tubular part 25 of the cover 24 are fit shallowly in the hood 44. Additionally, the cam follower 45 is advanced to an entrance of the cam groove 32. The lever 29 then is rotated. As a result, a cam action between the cam groove 32 and the cam follower 45 pulls the first connector 10 and the second connector 40 together. More specifically, the tabs 42*a* of the second terminal fittings 42 advance into the first housing 11 and are connected respectively with the first terminal fittings 12. At this time, the first housing 11 is fitted in the terminal accommodation part 43 of the second housing 41, with the front surface of the first housing 11 parallel to and confronting the front surface of the second housing 41. The sealing ring 46 (see FIG. 4) achieves a liquid-tight seal of the gap between the inner peripheral surface of the hood 44 and the peripheral surface of the front end of the first housing 11 as the first connector 10 is fit into the second connector 40. Therefore, liquid cannot penetrate from the outside into the gap between the hood 44 and the cover 24 and cannot penetrate into the gap between the hood 44 and the rubber boot 15 to reach the region where the first terminal fitting 12 and the second terminal fitting 42 are connected to each other. The sealing portion 21 of the rubber boot 15 also achieves a liquid-tight seal of the gap between the inner peripheral surface of the sealing portion 21 of the rubber boot 15 and the peripheral surface of the first housing 11. Therefore any liquid that penetrates into the hood 44 from the outside cannot reach the rear surface 11R (the surface from which the electric wire 13 is taken out) of the first housing 11 through the gap between the quadrangular tubular part 16 of the rubber boot 15 and the periphery of the first housing 11.

As described above, the sealing portion 21 on the rubber boot 15 elastically contacts the outer peripheral surface of the first housing 11. Thus, the gap between the inner peripheral surface of the rubber boot 15 and the outer peripheral surface of the first housing 11 is sealed. As a result, liquid cannot penetrate from the gap into the first housing 11 beyond the rear surface 11R. As described above, the sealing portion 21 seals the gap and is in contact with the outer peripheral surface of the first housing 11. Thus, the compressive elasticity amount of the sealing portion 21 is not affected by the posture of the first connector 10, when the first connector 10 is fit in the second connector 40. Therefore the sealing performance of the sealing portion 21 does not deteriorate even when the first connector 10 is fit obliquely in the second connector 40. Accordingly, it is possible to securely prevent liquid from penetrating into the first housing 11 beyond the rear surface 11R thereof from the gap between the rubber boot 15 and the first housing 11.

The cover 24 is mounted on the first housing 11 and covers the rubber boot 15. Additionally, the cover 24 has a higher rigidity than the rubber boot 15. The sealing portion 21 is sandwiched between the cover 24 and the first housing 11 over the entire periphery thereof. Therefore the compressive elasticity amount of the sealing portion 21 for the periphery of the first housing 11 is uniform over the entire periphery of the sealing portion 21. Thus the sealing portion 21 is capable of displaying a high degree of sealing performance.

The main lip 22 is formed on the inner peripheral surface of the sealing portion 21 and elastically contacts the peripheral surface of the first housing 11. The auxiliary lip 23 is formed on the outer peripheral surface of the sealing portion 21 at a position corresponding to the position of the main lip 22 and elastically contacts the inner peripheral surface of the cover 24. Thus, an elastic restoring force generated by the elastic contact of the auxiliary lip 23 with the cover 24 is applied as an elastic contact pressure of the main lip 22 against the first housing 11. Thus, the sealing performance of the sealing portion 21 is improved.

The positioning projections 14A, 14B project from the outer peripheral surface of the first housing 11 on each of the four sides of the approximately quadrangular first housing 11. These positioning projections 14A, 14B penetrate through the corresponding through-holes 20 of the approximately quadrangular pillar-shaped part 16 of the rubber boot 15 and fit in the respective positioning holes 28A, 28B of the approximately quadrangular part 25 of the cover 24. Therefore the cover 24 is mounted at a predetermined position of the first housing 11, and the gap between the peripheral surface of the first housing 11 and the inner peripheral surface of the cover 24 is kept constant. As a result, the sealing portion 21 is prevented from fluctuating in its compressive elasticity amount and displays a high sealing performance.

The invention is not limited to the embodiment described above with reference to the drawings. For example, the following embodiments are included in the technical scope of the present invention. Further, various modifications of the embodiments can be made without departing from the spirit and scope of the present invention.

The cover is mounted on the above-described housing. However, the cover may not be mounted on the housing in accordance with the invention.

The cover is made of synthetic resin in the illustrated embodiment. However, the cover may be made of metal.

The above-described connector is fit in the mating connector by using the lever. However, the invention is applicable to a connector that is fit in the mating connector without using a lever.

Four positioning projections are fit in the positioning holes of the cover in the above-described embodiment. However, the number of the positioning projections may be two, three, five or more.

In the first embodiment, the positioning projection is disposed forward from the sealing portion. But in the present invention, the positioning projection may be disposed rearward from the sealing portion or may be disposed forward and rearward from the sealing portion.

The auxiliary lip is formed on the sealing portion. However, the auxiliary lip may not be formed.

The positioning projections penetrate through the through-hole of the rubber boot. However, the rubber boot may have no through-hole and the inner peripheral surface of the rubber boot may elastically and closely contact the outer peripheral surface of the positioning projection. Thus, the gap between the through-hole and the positioning projection achieves a liquid-tight seal.

What is claimed is:

1. A connector, comprising:

a housing made of synthetic resin and having an outer peripheral surface, terminal fittings accommodated in the housing and electric wires fixed respectively to the terminal fittings and extended outside from a rear surface of the housing;

a tubular rubber boot mounted on the housing, the rubber boot covering the outer peripheral surface of the housing and the rear surface thereof, the electric wires being penetrated through the rubber boot, the tubular rubber boot having a sealing portion with an inner peripheral surface that elastically contacts the outer peripheral surface of said housing, the sealing portion having inner and outer surfaces, a main lip formed on the inner peripheral surface of the sealing portion and elastically contacting said outer peripheral surface of said housing, and an auxiliary lip formed on the outer peripheral surface of the sealing portion at a position substantially opposite to the main lip; and a cover formed from a material that has a higher rigidity than said rubber boot, the cover being mounted on the rubber boot and covering the sealing portion of the rubber boot so that the auxiliary lip formed on the outer peripheral surface of the sealing portion elastically contacts an inner peripheral surface of said cover and so that sealing portion of the rubber boot is sandwiched between said cover and said housing over an entire periphery of said sealing portion, whereby the connector is engageable with a mating connector so that a front surface of said housing confronts a front surface of a mating housing of the mating connector.

2. The connector of claim 1, wherein the housing and the rubber boot each are approximately quadrangular and have four sides, positioning projections projecting from the outer peripheral surface of said housing on at least two of the four sides thereof, holes formed in at least two of the sides of the rubber boot and engaging the positioning projections of the housing for securely positioning said rubber boot on the housing.

3. The connector of claim 2, wherein the cover is approximately quadrangular and has four sides, positioning holes formed in at least two of the sides of the cover and engaging the positioning projections of the housing for securely positioning said cover on the rubber boot while the rubber boot is positioned on the housing.

4. The connector of claim 3, wherein the positioning projections project from the outer peripheral surface of said housing on all four of the four sides thereof, holes formed in all four of the sides of the rubber boot and engaging the positioning projections of the housing for securely positioning said rubber boot on the housing.

5. The connector of claim 2, wherein the positioning holes are formed in all four of the sides of the cover and engage the positioning projections of the housing for securely positioning said cover on the rubber boot while the rubber boot is positioned on the housing.

6. The connector of claim 1, further a lever mounted on the cover for assisting a connection of the connector with the mating connector.

7. The connector of claim 1, wherein the rubber boot further has a step confronting the rear surface of the housing.

* * * * *